US009863117B2

(12) United States Patent
Calvert et al.

(10) Patent No.: US 9,863,117 B2
(45) Date of Patent: Jan. 9, 2018

(54) COUPLER FOR EARTH MOVING OR MATERIALS HANDLING MACHINE

(75) Inventors: Matthew James Calvert, Upper Hutt (NZ); David Aperahama Calvert, Upper Hutt (NZ)

(73) Assignee: Cascade Corporation, Fairview, OR (US)

( * ) Notice: Subject to any disclaimer, the term of this patent is extended or adjusted under 35 U.S.C. 154(b) by 2395 days.

(21) Appl. No.: 12/598,018

(22) PCT Filed: Mar. 6, 2009

(86) PCT No.: PCT/NZ2009/000030

§ 371 (c)(1),
(2), (4) Date: Apr. 20, 2010

(87) PCT Pub. No.: WO2009/110808

PCT Pub. Date: Sep. 11, 2009

(65) Prior Publication Data

US 2010/0232920 A1 Sep. 16, 2010

(30) Foreign Application Priority Data

Mar. 7, 2008 (NZ) ..... 566528

(51) Int. Cl.
*E02F 3/36* (2006.01)

(52) U.S. Cl.
CPC ..... *E02F 3/3627* (2013.01); *E02F 3/364* (2013.01); *E02F 3/365* (2013.01); *E02F 3/3645* (2013.01); *E02F 3/3663* (2013.01)

(58) Field of Classification Search
CPC ... B66F 9/12; E02F 3/36; E02F 3/3622; E02F 3/3627; E02F 3/3631; E02F 3/3663; E02F 3/3672; E02F 3/401; E02F 3/404; E02F 3/96; E02F 3/962
USPC ..... 414/723, 724
See application file for complete search history.

(56) References Cited

U.S. PATENT DOCUMENTS

| | | | | |
|---|---|---|---|---|
| 3,934,738 | A * | 1/1976 | Arnold | 414/723 |
| 4,034,816 | A * | 7/1977 | Lutich et al. | 173/15 |
| 4,311,428 | A * | 1/1982 | Arnold | 414/723 |
| 5,423,625 | A * | 6/1995 | Gebauer et al. | 403/322.3 |
| 6,332,747 | B1 * | 12/2001 | Lee | 414/723 |
| 6,691,438 | B2 * | 2/2004 | Fatemi | 37/468 |

(Continued)

FOREIGN PATENT DOCUMENTS

| | | |
|---|---|---|
| GB | 2 450 127 | 12/2008 |
| WO | WO 2006/083172 | 8/2006 |

(Continued)

*Primary Examiner* — Anna Momper
*Assistant Examiner* — Brendan Tighe
(74) *Attorney, Agent, or Firm* — Chernoff, Vilhauer, McClung & Stenzel, LLP

(57) ABSTRACT

A coupler is configured to couple an implement to an earth moving or materials handling machine. The coupler includes a locking member for locking a pin of an implement into a coupler in the recess. The locking member is driven by a hydraulic arrangement, with the hydraulic cylinder body being formed integrally with either the coupler body or the locking member. The coupler may be adapted to accommodate a range of implement pin spacings and/or diameters, so that the coupler can be used with different implements and in particular with different makes of implement.

2 Claims, 9 Drawing Sheets

(56) References Cited

U.S. PATENT DOCUMENTS

| | | | | |
|---|---|---|---|---|
| 7,770,311 | B2 * | 8/2010 | Hahnel | 37/468 |
| 2005/0214105 | A1 * | 9/2005 | Steig et al. | 414/723 |
| 2007/0199214 | A1 * | 8/2007 | McCormick et al. | 37/468 |
| 2007/0248445 | A1 * | 10/2007 | Honeyman et al. | 414/680 |
| 2010/0183417 | A1 * | 7/2010 | Martin | 414/723 |

FOREIGN PATENT DOCUMENTS

| | | | |
|---|---|---|---|
| WO | WO 2006083172 | A1 * | 8/2006 |
| WO | WO 2007070941 | A1 * | 6/2007 |

* cited by examiner

COUPLER FOR EARTH MOVING OR MATERIALS HANDLING MACHINE

This application is a National Stage Application of PCT/NZ2009/000030, filed 6 Mar. 2009, which claims benefit of Serial No. 566528, filed 7 Mar. 2008 in New Zealand and which application(s) are incorporated herein by reference. To the extent appropriate, a claim of priority is made to each of the above disclosed applications.

FIELD OF THE INVENTION

The invention relates to couplers for connecting buckets and other implements to earth moving or materials handling machines.

BACKGROUND TO THE INVENTION

Buckets and other implements for earth moving or materials handling machines such as excavators may be formed with a pair of parallel pins for engaging with the arm of the machine. Quick couplers are sometimes used which couple to the parallel pins and also to the arm of the machine.

Quick couplers are thus attached to the machine's arm and allow implements to be easily attached or removed. A quick coupler allows an operator of a machine to attach and remove implements without moving from the cab or operating position of the machine.

In general, couplers include a pair of parallel pins for coupling to the machine's arm. A pair of recesses are formed in the coupler body and are configured to receive the parallel pins of the implement. One or more locking mechanisms lock the received pins into one or both of the recesses.

It is an object of the invention to provide an improved coupler or at least to provide the public with a useful choice.

SUMMARY OF THE INVENTION

In a first broad aspect the invention provides a coupler for coupling an implement to an earth moving or materials handling machine, including:

a coupler body;

a first recess formed in the coupler body and configured to engage with a first pin of an implement;

a second recess formed in the coupler body and configured to engage with a second pin of an implement;

a locking member configured to extend to lock a second pin of an implement into the second recess and to retract to allow movement of a second pin of an implement into or out of the second recess; and a hydraulic cylinder body and shaft for extending or retracting the locking member, wherein the hydraulic cylinder body is formed integrally with one of the coupler body and the locking member.

Preferably the shaft is connected at one end to the other of the coupler body and the locking member.

Preferably the first pin is a front pin, the first recess is a front recess, the second pin is a rear pin and the second recess is a rear recess.

Preferably the rear and front recesses are positioned and dimensioned to engage with front and rear pins of implements over a range of front and rear pin diameters and/or spacings.

Preferably the pin spacing is in the range 100 mm to 400 mm

Preferably the pin diameter is in the range 30 mm to 60 mm.

Preferably the coupler is configured for attachment to an earth moving or materials handling machine having a weight less than 7500 kg, more preferably in the range 700 to 7500 kg.

Preferably the hydraulic cylinder body is formed integrally with the locking member.

Preferably the cylinder body and locking member are cast as a single piece. Preferably the cylinder body and locking member are investment cast.

Preferably the coupler body is formed as a single piece. Preferably the coupler body is cast as a single piece.

Alternatively the hydraulic cylinder body is formed integrally with the coupler body. In this case the cylinder body and coupler body are preferably cast as a single piece. Also, in this case, the locking member will be separate from the hydraulic cylinder body.

Preferably the coupler includes a second locking member for locking a front pin of an implement into the front recess.

Preferably the coupler is a quick coupler.

Preferably the machine is an excavator.

In a second broad aspect, the invention provides a method of fabricating a coupler for coupling an implement to an earth moving or materials handling machine, the method including:

forming a hydraulic cylinder body integrally with either a body of the coupler or a locking member for locking a pin of an implement into a recess in the coupler body.

In a third broad aspect the invention provides a coupler for coupling an implement to an earth moving or materials handling machine, including:

a coupler body;

a first recess formed in the coupler body and configured to engage with a first pin of an implement;

a second recess formed in the coupler body and configured to engage with a second pin of an implement;

a locking member configured to extend to lock a second pin of an implement into the second recess and to retract to allow movement of a second pin of an implement into or out of the second recess; and a hydraulic cylinder body and shaft for extending or retracting the locking member, wherein the locking member extends from the hydraulic cylinder body.

Preferably the shaft is connected at one end to the coupler body.

Preferably the first pin is a front pin, the first recess is a front recess, the second pin is a rear pin and the second recess is a rear recess.

Preferably the rear and front recesses are positioned and dimensioned to engage with front and rear pins of implements over a range of front and rear pin diameters and/or spacings.

Preferably the pin spacing is in the range 100 mm to 400 mm:

Preferably the pin diameter is in the range 30 mm to 60 mm.

Preferably the coupler is configured for attachment to an earth moving or materials handling machine having a weight less than 7500 kg, more preferably in the range 700 to 7500 kg.

Preferably the hydraulic cylinder body is formed integrally with the locking member.

Preferably the cylinder body and locking member are manufactured as a single piece.

Preferably the coupler body is cast as a single piece.

Preferably the coupler includes a second locking member for locking a front pin of an implement into the front recess.

Preferably the coupler is a quick coupler.

Preferably the machine is an excavator.

In this specification, the term "hydraulic cylinder body" means the body in which the piston rides.

Earth moving or materials handling machines can be adapted for and/or used in various applications including construction, earthworks, demolition, forestry, drainage, quarrying, mining etc. The term "earth moving or materials handling machine" includes machines used in these and other applications. In particular, earth moving and materials handling machines include excavators and telehandlers.

BRIEF DESCRIPTION OF THE DRAWINGS

The invention will now be described by way of example only, with reference to the accompanying drawings, in which.

DETAILED DESCRIPTION

FIGS. 1 to 5 are perspective views of one embodiment of coupler 20, more specifically a quick coupler. The coupler 20 includes an upper section 21 configured to attach to an earth moving or materials handling machine, for example to the arm of an excavator.

Figure 1:
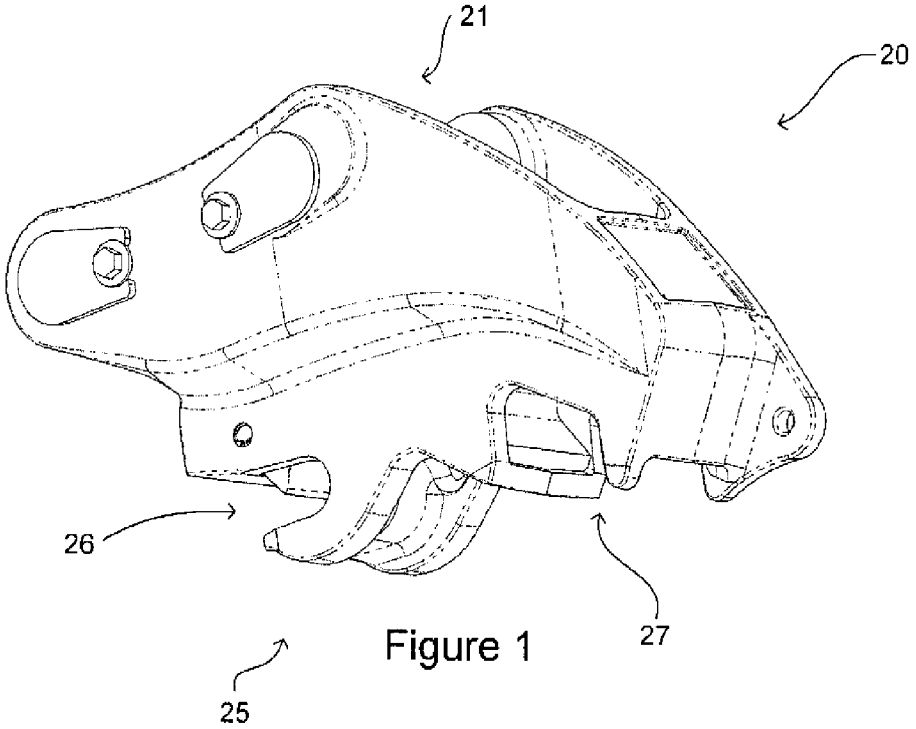
FIGS. 1 to 5 are perspective views from different angles of a coupler according to one embodiment.
Figure 2:
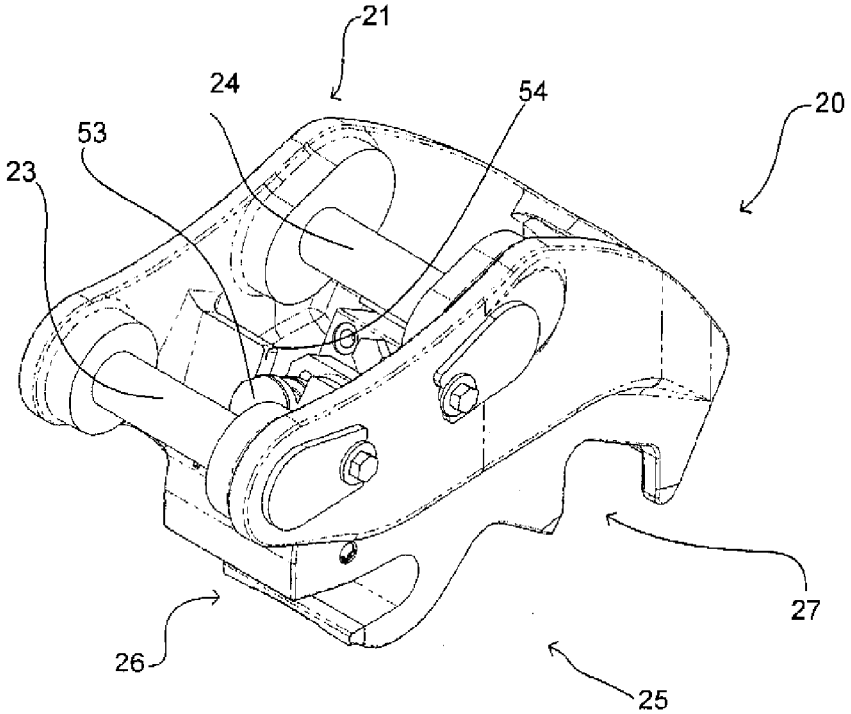
Figure 3:
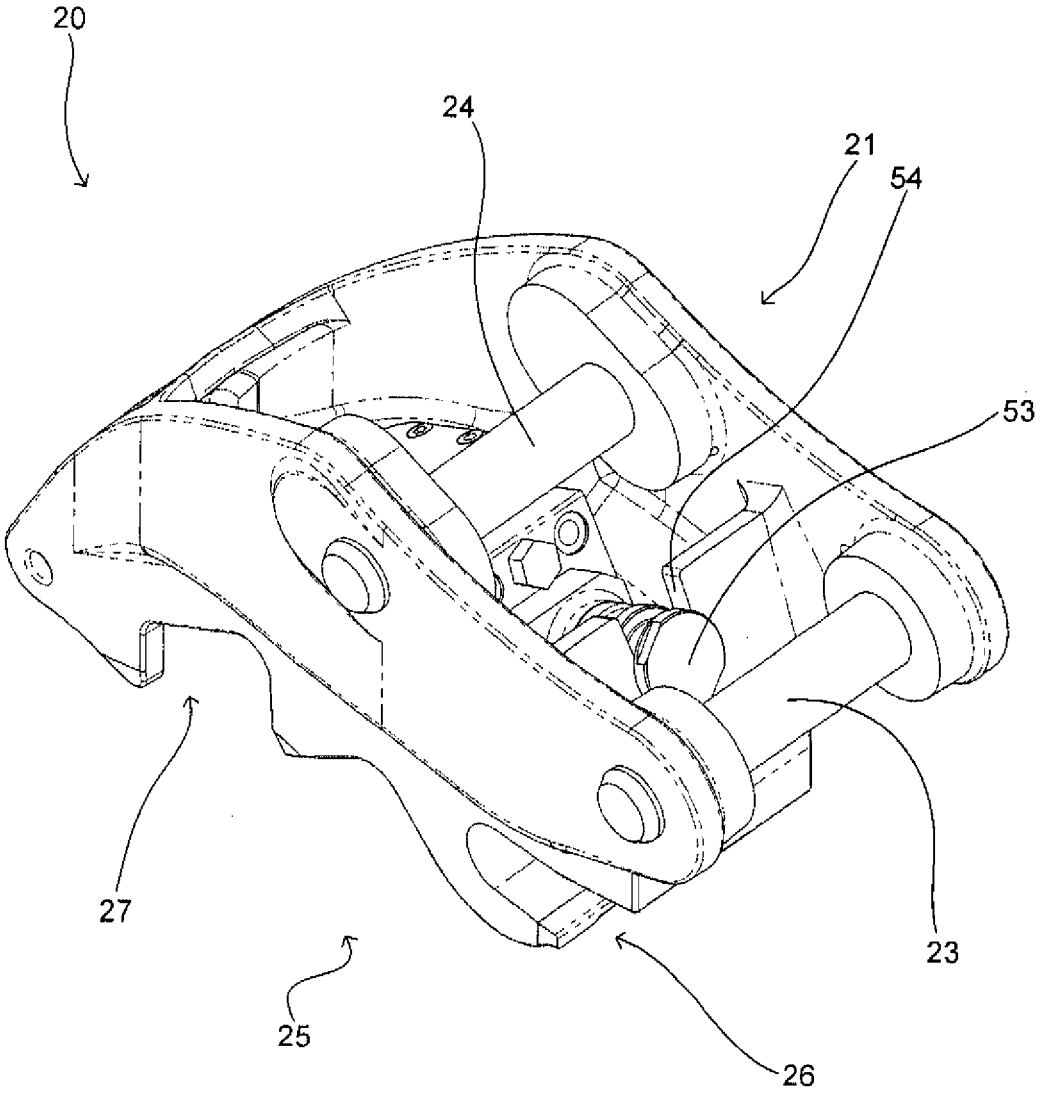

As shown most clearly in FIGS. 2 and 3, the upper section 21 includes a pair of pins 23, 24 for attachment to an earth moving or materials handling machine. The diameter and centre to centre spacing of the pins 23, 24 may be designed to suit any particular earth moving or materials handling machine.

The coupler 20 also includes a lower section 25 configured to attach to an implement.

Figure 12:
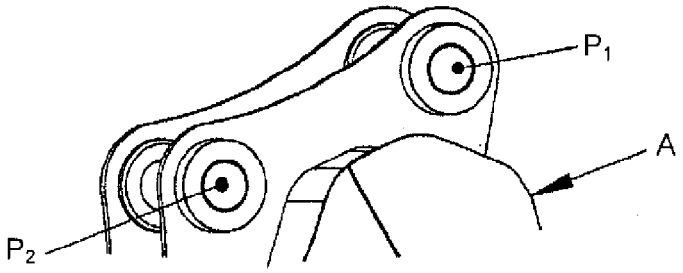
FIG. 12 shows a top section of an implement.

Suitable implements include buckets, tilt buckets, rippers, ploughs, rakes, spades, rollers or any other implements for attachment to earth moving or materials handling machines. Each implement includes a first, front pin and a second, rear pin. The diameter of the pins and spacing between the pins varies across different makes of implement. FIG. 12 shows the top section of an implement A, including a front pin $P_1$ and a rear pin $P_2$.

Figure 5:
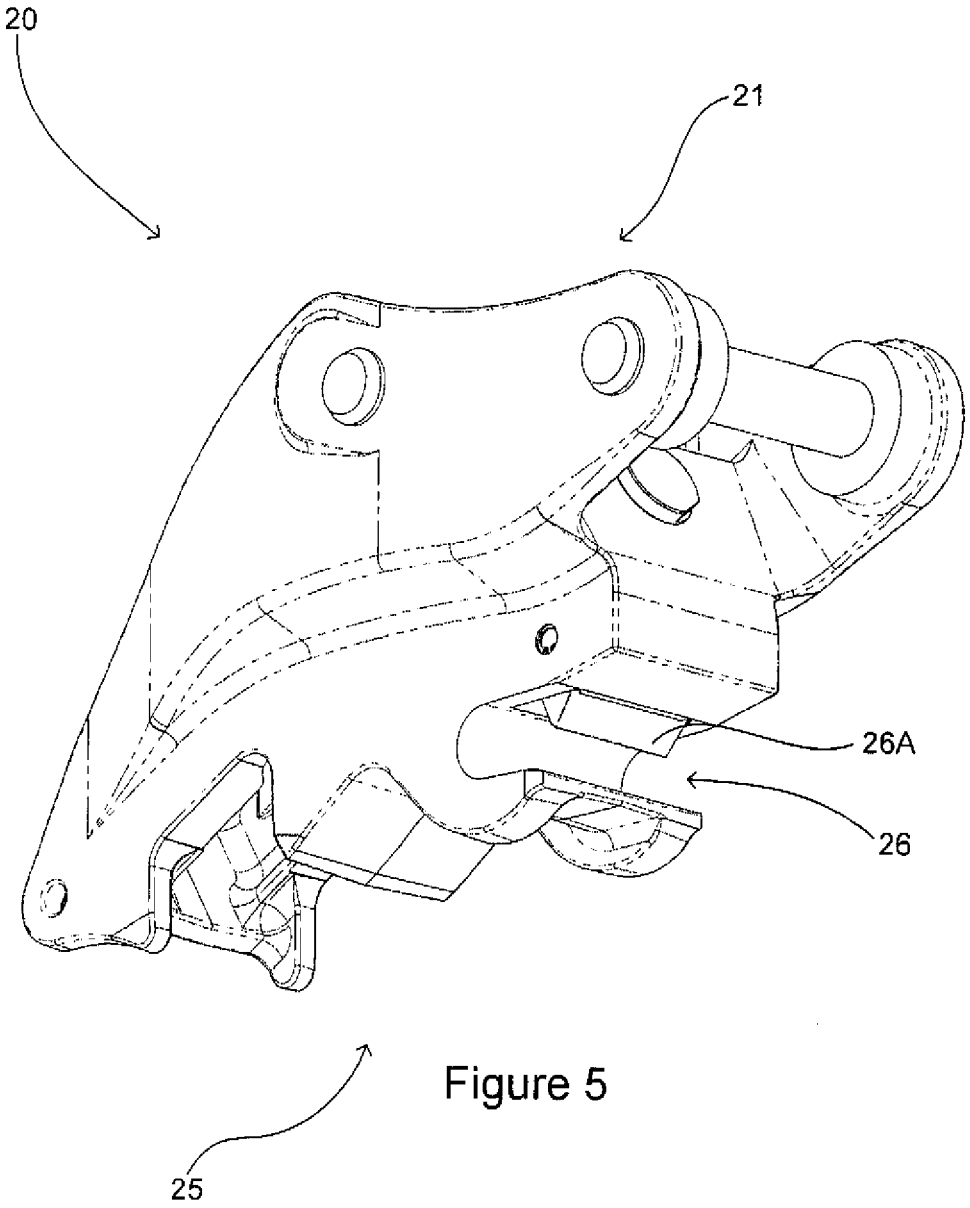

The lower section 25 includes a first, front recess 26 which is configured to receive an implement's front pin. The front recess 26 may include a suitable locking mechanism 26A (FIG. 5). For example, a locking mechanism such as disclosed in Wedgelock Equipment Limited's NZ App. No. 546893/552294 may be used.

The lower section 25 also includes a second, rear recess 27 which is configured to receive an implement's rear pin. A locking mechanism (described below) locks the rear pin into this rear recess, such that the shape of the front recess 26 together with the locked rear pin securely attach the implement to the coupler 20.

Figure 6:
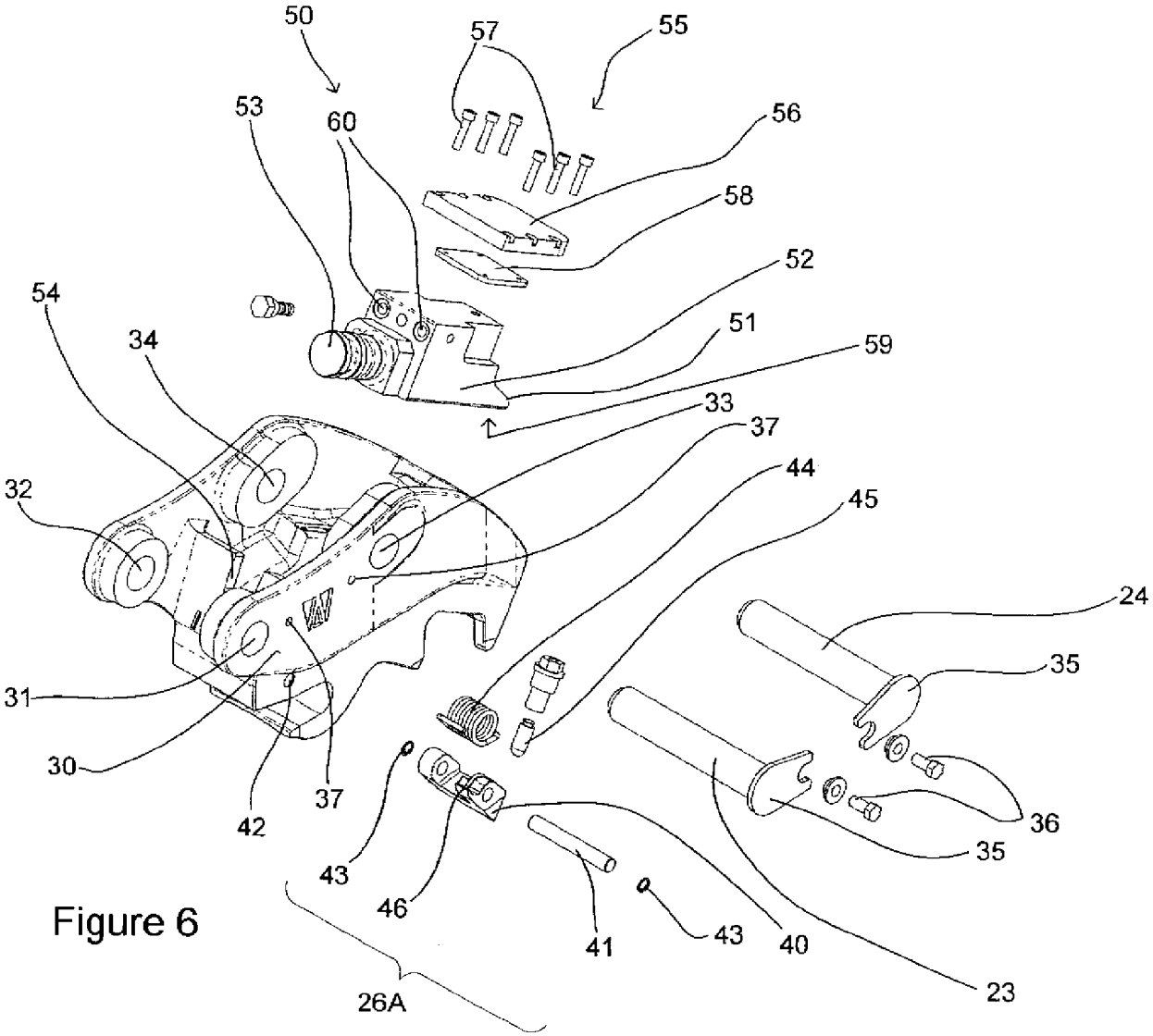
FIG. 6 is an exploded view of the coupler of FIGS. 1 to 5.

FIG. 6 is an exploded view of the coupler 20. The coupler 20 includes a coupler body 30 which may be formed as a single integral piece. The coupler body may be cast by any suitable casting process, including: sand casting or investment casting. Some machining of the coupler body following casting may be required, such as boring and threading of holes etc.

The pins 23, 24 pass through bores 31, 32, 33, 34 formed in the coupler body 30. Each pin 23, 24 may be formed with a flange 35 which can be secured to the coupler body using fasteners 36 which engage with holes 37 in the coupler body 30. This both secures the pins 23, 24 in position and prevents rotation of the pins 23, 24 relative to the coupler body 30.

FIG. 6 also shows one embodiment of locking mechanism 26A for locking an implement's front pin into the front recess 26. This mechanism is described in detail in NZ App. No. 546893/552294 and will be described only briefly below.

The locking mechanism 26A includes a locking member 40 which rotates about an axle 41 located in a bore 42 in the coupler body 30. The axle 41 is kept in position by retaining rings 43.

A coil spring 44 biases the locking member 40 into a locked position. A linear actuator 45 (such as a hydraulic ram) moves the locking member 40 into an unlocked position when required.

The locking mechanism 26A shown differs slightly from that disclosed in NZ App. No. 546893/552294. In NZ App. No. 546893/552294 the hydraulic ram drives a lug (marked 30 in NZ App. No. 546893/552294) which is fixed to the locking member. For reduced size and number of parts and for simplicity, in the coupler of FIG. 6 the linear actuator 45 drives the locking member 40 directly, via the engagement portion 46 of the locking member 40.

A second locking mechanism 50 is configured to lock an implement's rear pin into the rear recess 27 of the coupler body 30.

This locking mechanism 50 includes a locking member 51 which may be wedge shaped, as shown. The locking member 51 is preferably formed integrally with a hydraulic cylinder body 52. That is, the locking member and the hydraulic cylinder body may be formed as a single piece. The locking member 51 and hydraulic cylinder body 52 may be formed by any suitable casting process, such as investment casting.

Investment casting provides a high quality and accurate finish, making it particularly suitable for forming the bore of the hydraulic cylinder body 52.

The locking mechanism 50 thus extends from the hydraulic cylinder body 52.

Figure 4:
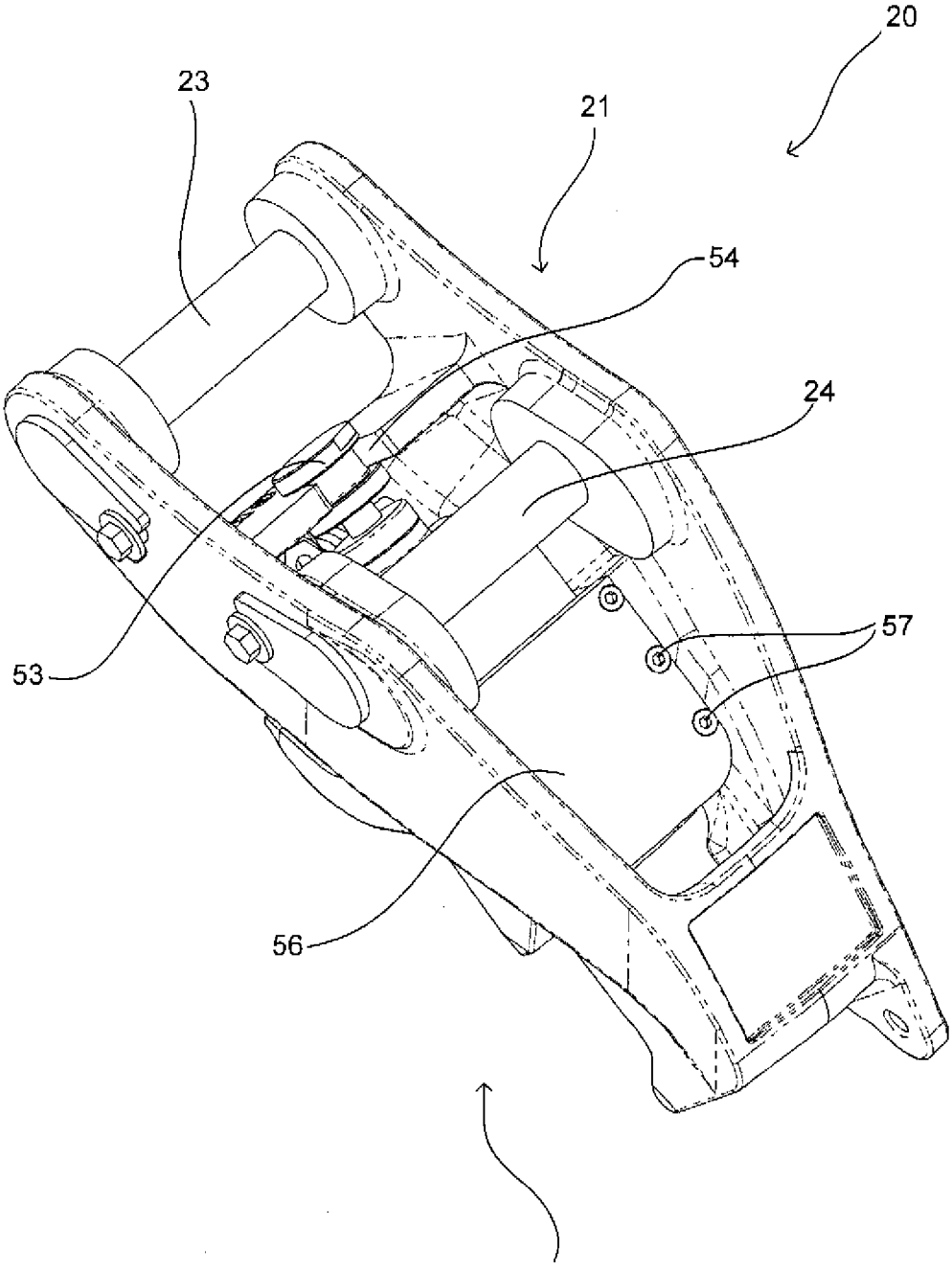

A shaft is connected to a piston within the hydraulic cylinder body and the head 53 of the shaft may be shaped to reside within a slot 54 in the coupler body 30, as is clear from FIGS. 3 to 5. Thus the shaft of the hydraulic cylinder is fixed with respect to the coupler body 30 while the integral cylinder body 52 and locking member 51 slides with respect to the shaft and the coupler body to lock an implement's rear pin into the rear recess 27.

The integral cylinder body 52 and locking member 51 is connected to the coupler body by attachment arrangement 55, which includes a cover plate 56 configured for attachment to the coupler body 30 using a number of fasteners 57.

The attachment arrangement 55 may also include a contact plate 58 which sits in a recess (not visible in FIG. 6 but shown in FIG. 7) on the underside of the cover plate 56. The contact plate 58 may be formed from a suitable material (such as polytetrafluoroethylene (PTFE)) to reduce friction between the sliding cylinder body 52 and locking member 51 and the stationary contact plate 58 and cover plate 56.

PTFE strips may also be provided between the lower surface 59 of the integral cylinder body 52 and locking member 51 and the coupler body 30, again in order to reduce friction.

The cylinder body 52 is formed with a pair of hydraulic ports 60 for feeding hydraulic fluid into or out of the cylinder, in a manner that will be easily understood by the skilled reader.

Figure 7:
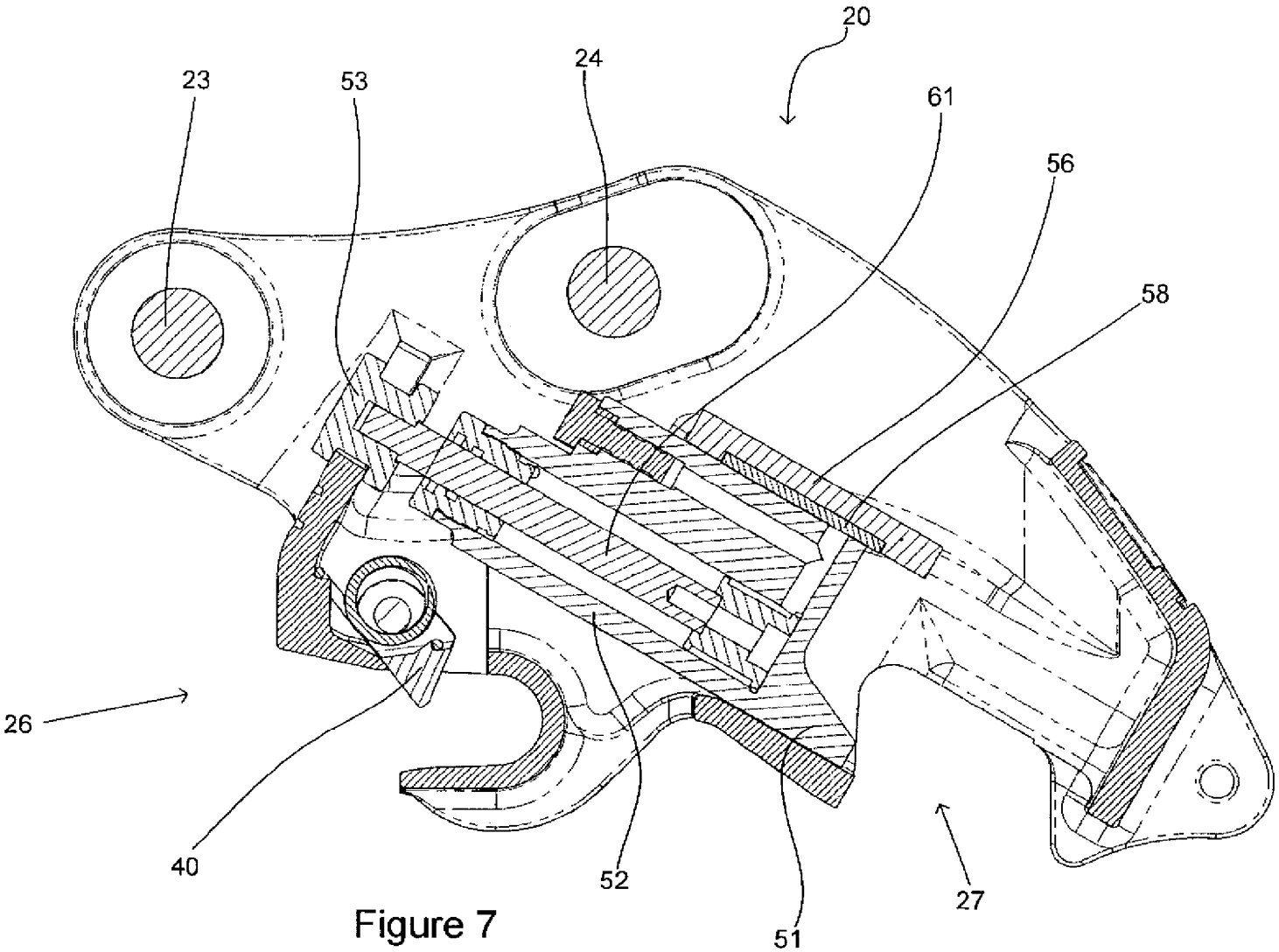
FIG. 7 is a cross-section through the coupler of FIGS. 1 to 5.

FIG. 7 is a cross-section through the coupler 20. This view shows the integral cylinder body 52 and locking member 51 in a retracted position. In this position, an implement's rear pin is able to move freely into or out of the rear recess 27.

This cross-section also clearly shows the positions of the cover plate 56 and contact plate 58 with respect to the cylinder body 52.

In the position shown in FIG. 7, the coupler mounted on an earth moving or materials handling machine can be manipulated such that the front recess 26 engages with an implement's front pin. The locking mechanism 26A (FIG. 6) may be such that the locking member freely allows the pin to enter the recess, rotating up into the body of the coupler 20 before returning the locking member 40 to the protruding position shown. Thus, motion of the pin into the front recess is allowed, but motion out of the recess is prevented by the locking member 40.

The coupler may then be manipulated such that the rear recess 27 engages with the implement's rear pin. When the pin is correctly positioned, a hydraulic actuator drives movement of the hydraulic cylinder body 52 with respect to the hydraulic shaft & piston assembly 61, from the position shown in FIG. 7 to the position shown in FIG. 8.

Figure 8:
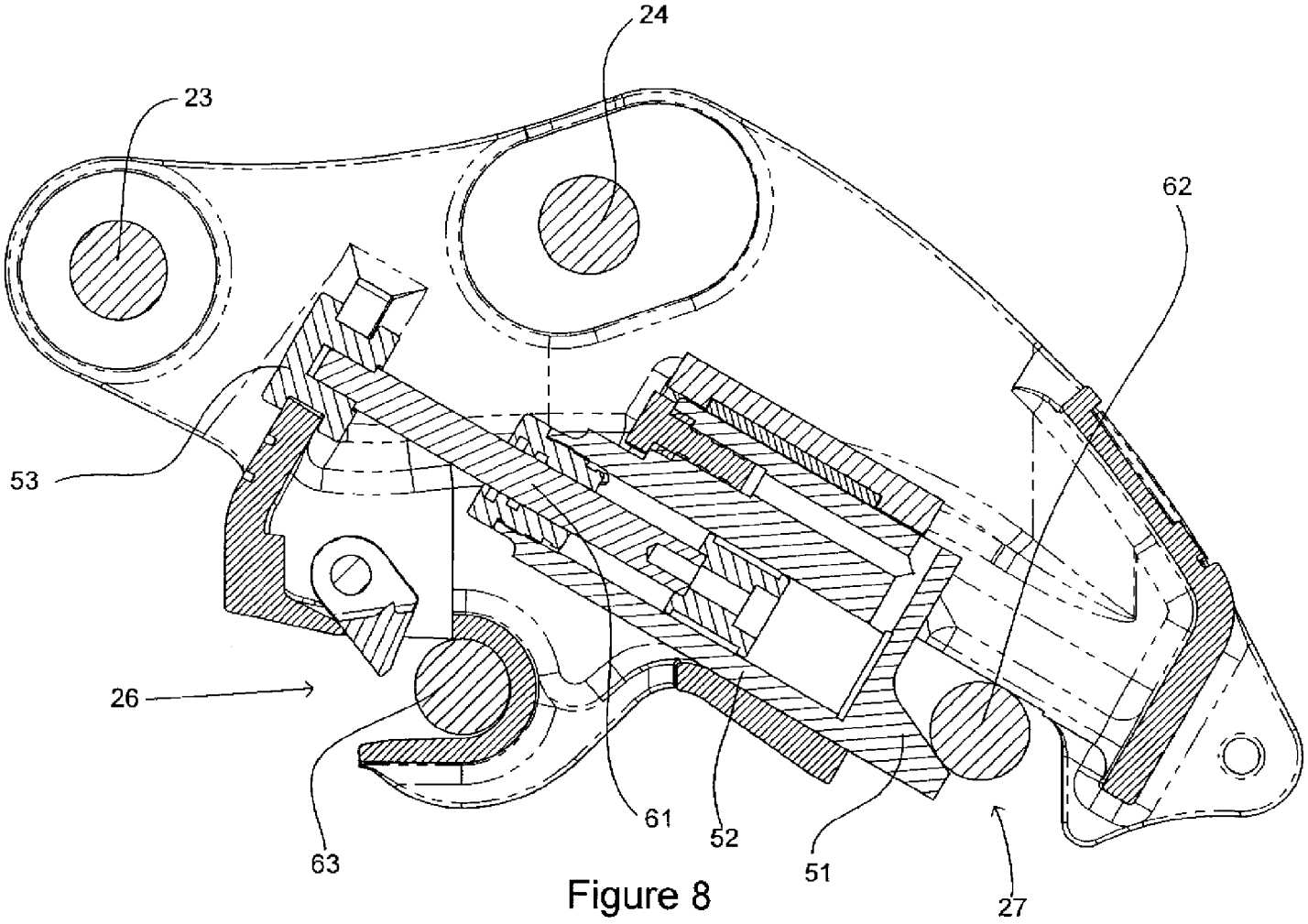
FIG. 8 is a second cross-section through the coupler of FIGS. 1 to 5.

In FIG. 8 the locking member 51 and cylinder body 52 have extended, such that the locking member 51 extends into the rear recess 27 and locks the rear pin 62 of an implement into the rear recess. FIG. 8 also shows the position of the front pin 63 of the implement in the front recess 26.

Figure 9:
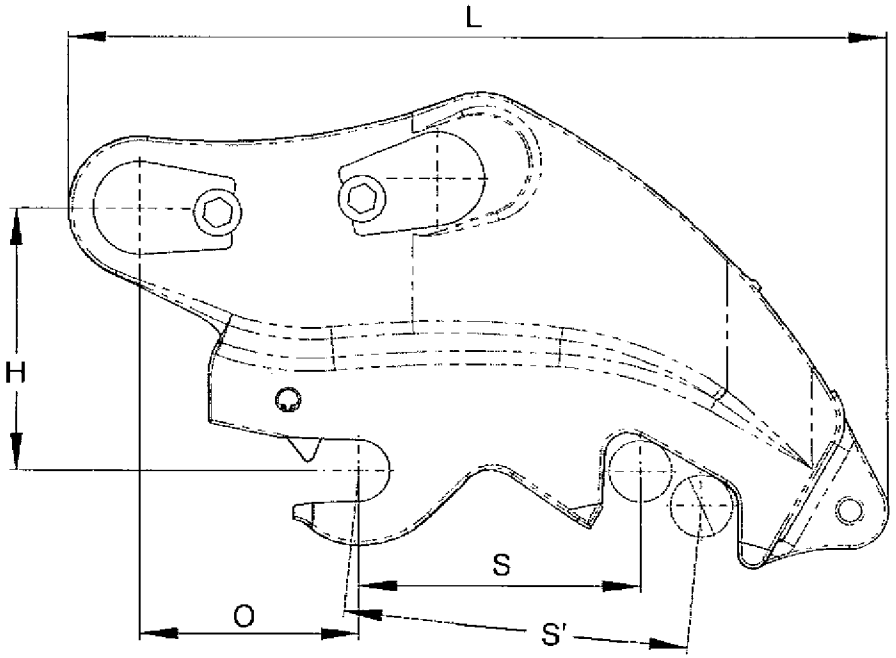
FIG. 9 is a side view of a coupler.
Figure 10:
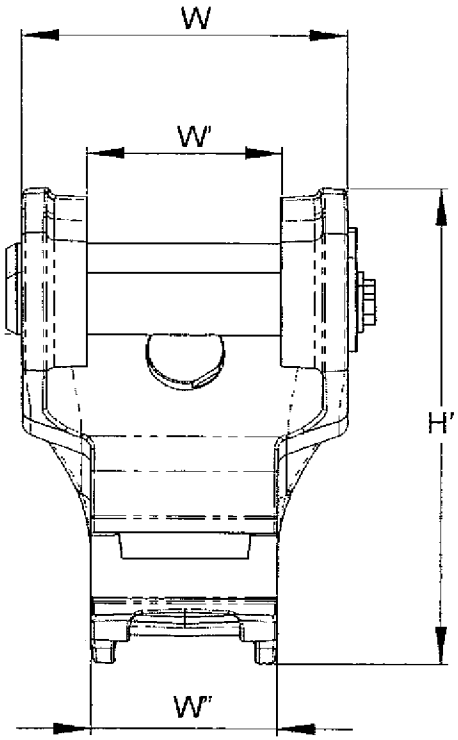
FIG. 10 is an end view of a coupler.

FIGS. 9 and 10 show one particular embodiment, in which the coupler is suitable for use with mini earth moving or materials handling machines. Mini earth moving or materials handling machines have a weight in the range 700 to 7500 kg. The dimensional data given below is given solely for the purpose of describing one embodiment of the invention and is not to be regarded as limiting the scope of protection sought.

This coupler may have a length L (FIG. 9) of around 524 mm. The coupler may be configured to couple to implements having minimum and maximum pin spacings of 180 and 220 mm respectively. The minimum and maximum pin spacings for a particular configuration are indicated by the dimensions S and S' in FIG. 9.

The coupler may be configured to couple to a range of pin sizes. In particular, the implement's pins 62, 63 as an example may be between 35 mm and 40 mm in diameter.

Alternative configurations could accommodate other combinations of pin diameters such as 40 mm and 45 mm etc.

The height H between the front pin 23 connecting the coupler to an earth moving or materials handling machine and the centre of the front recess 26 may be around 170 mm. The front recess 26 may be offset by a distance O behind the front pin 23. The distance O may be around 140 mm.

As shown in FIG. 10, the coupler may have a width W at the top of the coupler around 210 mm. The width W' between the inside walls of the coupler may be between 122 and 147 mm. The overall height H' of the coupler may be around 308 mm. The width W" at the bottom of the coupler may be around 121 mm.

In general, dimensions of couplers may vary depending on the size or type of earth moving or materials handling machine for which the coupler is designed.

Figure 11:
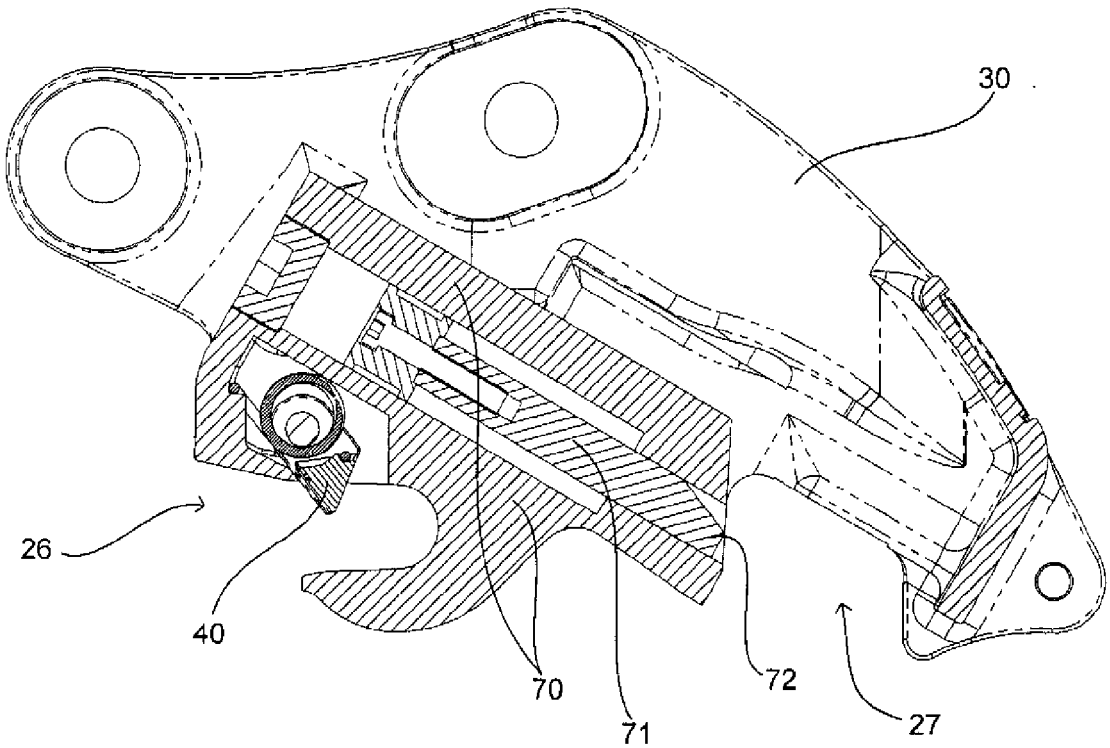
FIG. 11 is a cross-section through a coupler according to a further embodiment.

FIG. 11 shows an alternative embodiment, in which the cylinder body 70 is formed integrally with the coupler body 30, again by casting (including investment casting) or any other suitable process for forming the integral coupler body and cylinder body as a single piece. In this embodiment, the end of the hydraulic shaft 71 is connected to or formed integrally with the locking member 72.

Forming the cylinder body integrally with either the coupler body or the locking member reduces the number of parts in the coupler. This coupler is particularly suited to smaller earth moving or materials handling machines. With these machines the size of the coupler is limited and incorporating the hydraulic cylinder body into either the locking member or the coupler body enables the various components to be more easily contained in a smaller coupler. This is especially true of couplers suitable for a range of implements, since a greater range of displacement of the locking mechanism is required to accommodate a range of pin spacings and/or diameters, so that a long-stroke cylinder must be used.

The coupler is particularly suited to earth moving or materials handling machines having a weight less than 7500 kg, particularly machines having a weight in the range 700 to 7500 kg. However, the coupler may be used with earth moving or materials handling machines of any size.

The coupler body may be formed as a single piece. This eliminates many machining steps, making the coupler simpler and less costly to produce.

The coupler is configured to couple to a range of implements from different suppliers. These implements will have different pin diameters and pin spacings, but the coupler allows a range of implements to be used with a single coupler. For example, the coupler may accommodate pin spacings in the range 100 to 400 mm and pin diameters in the range 30 to 60 mm.

While the present invention has been illustrated by the description of the embodiments thereof, and while the embodiments have been described in detail, it is not the intention of the Applicant to restrict or in any way limit the scope of the invention to such detail. Additional advantages and modifications will readily appear to those skilled in the art. Therefore, the invention in its broader aspects is not limited to the specific details, representative apparatus and methods, and illustrative examples shown and described. Accordingly, departures may be made from such details without departure from the spirit or scope of the Applicant's general inventive concept.

What is claimed is:

1. A coupler for coupling an implement to an earth moving or materials handling machine, including:

a coupler body;

a first recess formed in the coupler body and configured to engage with a first pin of an implement;

a second recess formed in the coupler body and configured to engage with a second pin of an implement;

a first locking member configured to extend to lock a second pin of an implement into the second recess and to retract to allow movement of a second pin of an implement into or out of the second recess; and a hydraulic cylinder body and shaft for extending or retracting the first locking member, wherein the hydraulic cylinder body is formed integrally within one of the coupler body and the first locking member;

wherein the cylinder body and locking member are manufactured as a single piece;

wherein the cylinder body and the locking member are cast as a single piece.

2. A coupler as claimed in claim 1 wherein the cylinder body and the locking member are investment cast.

* * * * *